US006415767B1

(12) United States Patent
Mahr

(10) Patent No.: US 6,415,767 B1
(45) Date of Patent: Jul. 9, 2002

(54) FUEL INJECTION FOR AN INTERNAL COMBUSTION ENGINE, WITH A MULTISTAGE HIGH-PRESSURE PUMP AND TWO PRESSURE RESERVOIRS

(75) Inventor: Bernd Mahr, Plochingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/700,280

(22) PCT Filed: Jan. 13, 2000

(86) PCT No.: PCT/DE00/00105

§ 371 (c)(1),
(2), (4) Date: Feb. 21, 2001

(87) PCT Pub. No.: WO00/55497

PCT Pub. Date: Sep. 21, 2000

(30) Foreign Application Priority Data

Mar. 12, 1999 (DE) ..... 199 10 976

(51) Int. Cl.[7] ..... F02M 41/00
(52) U.S. Cl. ..... 123/456; 123/447
(58) Field of Search ..... 123/456, 447, 123/514, 458, 497, 506

(56) References Cited

U.S. PATENT DOCUMENTS

| | | | | |
|---|---|---|---|---|
| 4,478,197 A | * | 10/1984 | Yasuhara et al. | 123/514 |
| 4,674,448 A | * | 6/1987 | Steiger | 123/23 |
| 5,020,498 A | * | 6/1991 | Linder et al. | 123/450 |
| 5,146,894 A | * | 9/1992 | Rembold et al. | 123/447 |
| 5,433,182 A | * | 7/1995 | Augustin et al. | 132/456 |
| 5,878,718 A | * | 3/1999 | Rembold et al. | 123/456 |

* cited by examiner

*Primary Examiner*—Willis R. Wolfe
*Assistant Examiner*—Mahmoud Gimie
(74) *Attorney, Agent, or Firm*—Ronald E. Greigg

(57) ABSTRACT

In a fuel injection system for an internal combustion engine, having at least two different, high system pressures, in which a first pressure reservoir supplied by a first pump is provided for the lower system pressure and a second pressure reservoir supplied by a second pump is provided for the higher system pressure, and in which at least the second pressure reservoir or a fuel injection can be made to communicate by line with the injectors of the individual cylinders of the engine. The second pump communicates on its inlet side with the first pressure reservoir.

14 Claims, 8 Drawing Sheets

FUEL INJECTION FOR AN INTERNAL COMBUSTION ENGINE, WITH A MULTISTAGE HIGH-PRESSURE PUMP AND TWO PRESSURE RESERVOIRS

This is a 35 USC application of PCT/DE 00/00105 filed on Jan. 13, 2000.

PRIOR ART

The invention is based on a fuel injection system for an internal combustion engine, the fuel injection system having two high pressure pumps that supply fuel to the injection system at different pressures.

One such fuel injection system is disclosed for instance in WO 98/09068 A1.

The use of fuel injection systems with pressure reservoirs is known in diesel engines and in direct gasoline injection engines. These systems employ a high-pressure pump and sometimes a prefeed pump which preferred pump supplies fuel at pressure of up to about 10 bar). Systems with intake throttle regulation are also known.

In the injectors for the injection of the diesel fuel, a distinction is presently made between stroke- and pressure-controlled systems. In a pressure-controlled fuel injection system, a valve body (such as a nozzle) is open by the fuel pressure in the nozzle chamber of the injector controlled fuel injection system, the opening and closing of the injection opening is effected with the aid of a valve body on the basis of the hydraulic cooperation of two fuel pressures, one in the nozzle chamber and the other in a control chamber. The pressure at which fuel emerges from the nozzle chamber into the cylinder is called the injection pressure, while the pressure at which the fuel is available or is stored in the injection system is called the system pressure. As for the injectors, there are also injection nozzles with a variable injection port cross section (vario-nozzle) and with a two-stage nozzle needle stroke.

In the stroke-controlled injection system known from WO 98/09068 A1, fuel from a fuel tank is compressed to two different, high system pressures, each by means of a different pump, and fed into a respective pressure reservoirs. Via a valve control, either the higher or the lower system pressure can be carried into the nozzle chamber of an injector.

From European Patent Disclosure EP 0 711 914 A1, a pressure-controlled injection system is also known, in which with the aid of a high-pressure pump, fuel is compressed to a first, high system pressure of about 1200 bar and stored in a first pressure reservoir. The fuel at high pressure is also fed into a second pressure reservoir, in which by regulation of its fuel delivery by means of a 2/2-way valve, a second high system pressure of approximately 400 bar is maintained. Via a valve control unit, either the lower or the higher system pressure can be carried into the nozzle chamber of an injector. There, a spring-loaded valve body is lifted from its valve seat by the pressure, so that fuel can emerge from the nozzle opening.

ADVANTAGES OF THE INVENTION

Because of the capability of having two pressures, or two pumping stages available, the lower system pressure (first high-pressure stage) can be used to seal against the leakage quantity from the second pressure stage (higher system pressure). Both pumps are preferably accommodated in one housing.

The pressure of the first high-pressure stage (for instance, approximately 200 bar) can, for instance, be utilized to enable a hydraulic valve adjustment of the inlet and outlet valves, enable adjustment of the camshaft, enable actuation of engine braking systems, and so forth. Also with the pressure of the first high-pressure stage, a preinjection and/or a postinjection of fuel can be achieved to help control emissions.

For certain applications, such as in Otto engines, a hydraulic step-up from fuel pressure to lubricating oil pressure or vice versa can be done selectively in the first and second high-pressure stage, respectively. There is also the capability of using the pressure of the first high-pressure stage to control the opening cross section or to trigger injection nozzles (control pressure) under stroke or pressure control. The control of the stroke can be done quite simply via pressure/travel (spring force) or via a fixed stop. The pressures can be switched via piezoelectric or magnet valves, and the control pressure for all the cylinders can be switched either centrally via one valve or locally via a plurality of valves. With the control pressure of the first high-pressure stage, a vario-nozzle can for instance also be triggered. The system is suitable for both Otto and diesel engines.

The fuel injection system of the present invention furthermore enables the following:

- better efficiency in comparison to systems with only one high-pressure pump or high-pressure stage.
- better sealing off of the pump from higher pressures.
- control of systems present in the engine, such as inlet and outlet devices, via the fuel system.
- a compact structure. Piezoelectric or magnet valves can be provided on the pressure reservoir or pressure reservoirs and need not be disposed directly in or on the nozzle holder in the cylinder head.
- triggering of injection nozzles under pressure or stroke control and also infinitely variably or via a stroke stop, regardless of the injection pressure.
- low electrical power for actuating piezoelectric or magnet valves, since low control pressures and short travel distances are possible.
- a modular design.
- the fact that the system is free in terms of the choice of the injection onset. Both preinjection and postinjection of fuel are therefore possible.
- the use of the pressure of the first high-pressure stage for a preinjection and/or postinjection. Because of the low injection pressure, soot development and oil thinning are largely avoided.

Further advantages and advantageous features of the subject of the invention can be learned from the description, drawing and claims.

BRIEF DESCRIPTION OF THE DRAWINGS

Various exemplary embodiments of the fuel injection system according to the invention for a four-cylinder engine are schematically shown in the drawing and explained in the ensuing description. Shown are.

DESCRIPTION OF THE EXEMPLARY EMBODIMENTS

Figure 1A:
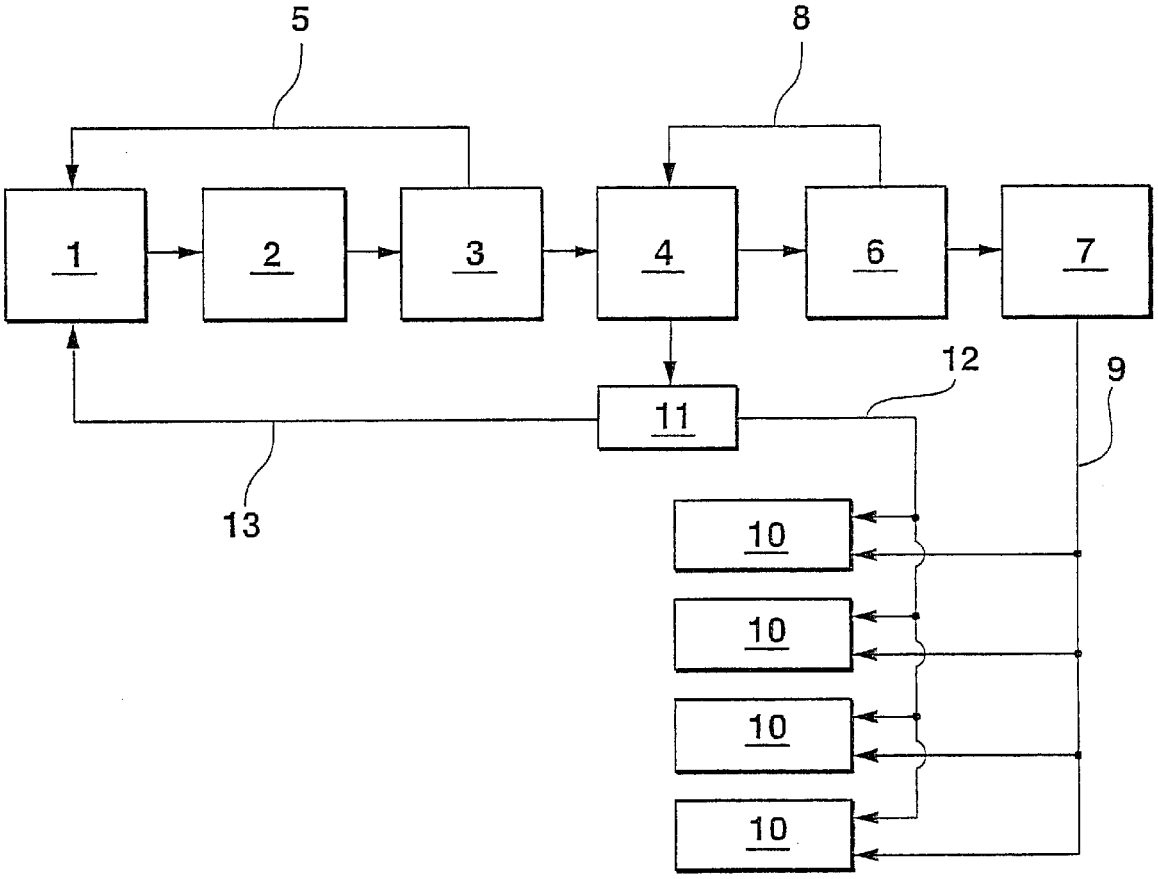
FIG. 1*a*, an exemplary embodiment having a central valve unit for triggering the injectors at the lower system pressure and with a leakage line for the valve unit.

In each of the injection systems shown in the drawings, fuel from a fuel tank 1 via a filter 2 is compressed by means of a first high-pressure pump 3 to a system pressure, for instance of 200 bar, and pumped (first high-pressure stage) into a first pressure reservoir 4 (for instance a rail). The leakage from the first high-pressure pump 3 is fed back into the fuel tank 1 via a line 5.

In a further compressor stage, the fuel from the first pressure reservoir 4 is further compressed by means of a second high-pressure pump 6 to the desired injection pressure, for instance up to 2000 bar, optionally with further intake throttle regulation, and pumped into a second pressure reservoir 7 (such as a rail). For both pumps, in-line pumps, distributor pumps, diaphragm pumps, and so forth are suitable. Naturally, the first high-pressure stage must be capable of pumping at least the complete full-load quantity. The leakage from the second high-pressure pump 6 is fed back into the first pressure reservoir 4 via a line 8.

The four injectors 10 that inject fuel into the individual cylinders communicate by line with the second pressure reservoir 7 for an injection at the higher system pressure and with the first pressure reservoir 4 for an injection at the lower system pressure.

Figure 1B:
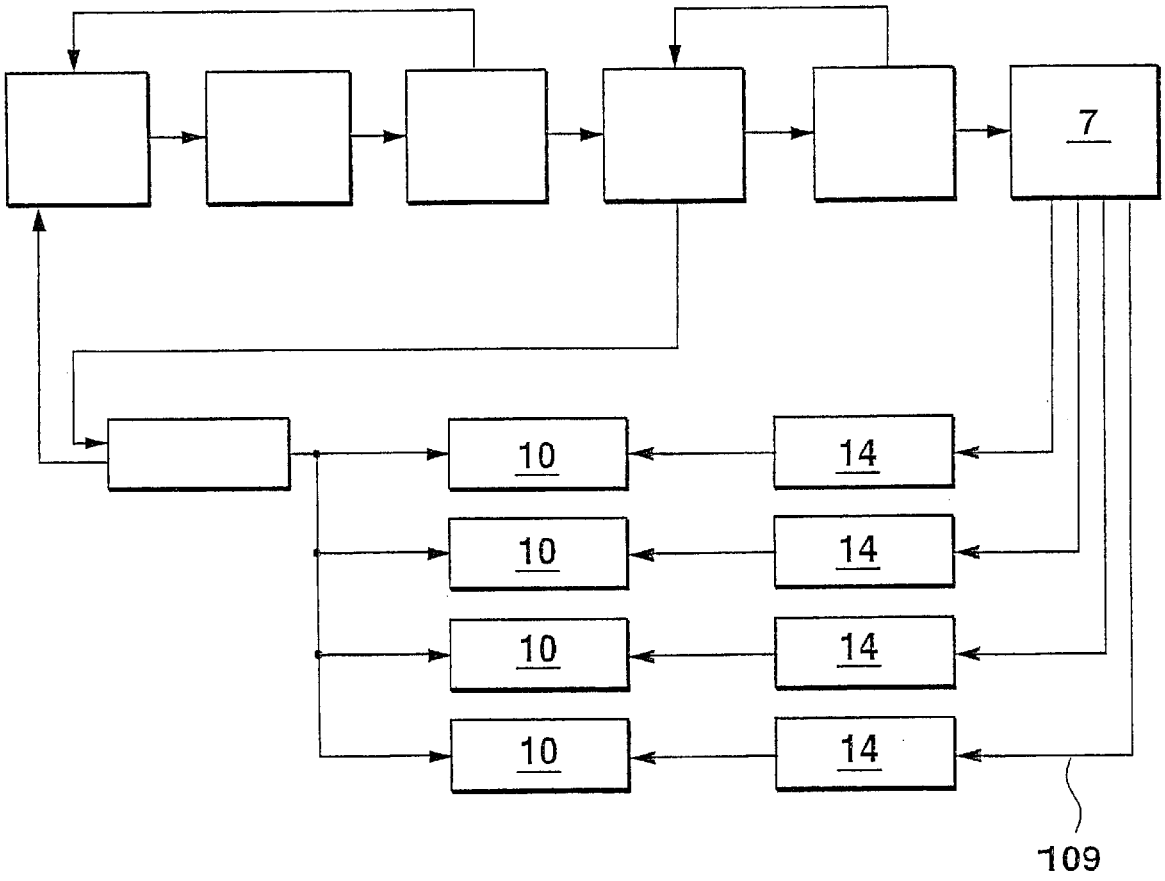
FIG. 1*b*, an exemplary embodiment corresponding to FIG. 1*a*, in which in addition one valve unit for the higher system pressure is provided for each injector.

In the exemplary embodiment of FIG. 1*a*, the fuel from the second pressure reservoir 7 is carried to all the injectors 10 via one common high-pressure line 9. The fuel from the first pressure reservoir 4 is also carried, controlled centrally by a valve unit 11, to all the injectors 10 via a common high-pressure line 12. The leakage from the central valve unit 11 is fed back into the fuel tank 1 via a line 13. The exemplary embodiment of FIG. 1*b* differs from that of FIG. 1*a* in that the injectors 10 communicate with the pressure reservoir 7 via separate high-pressure lines 109. Via one (local) valve unit 14 each in each high-pressure line 109, the injection can be controlled individually for each cylinder.

Figure 2A:
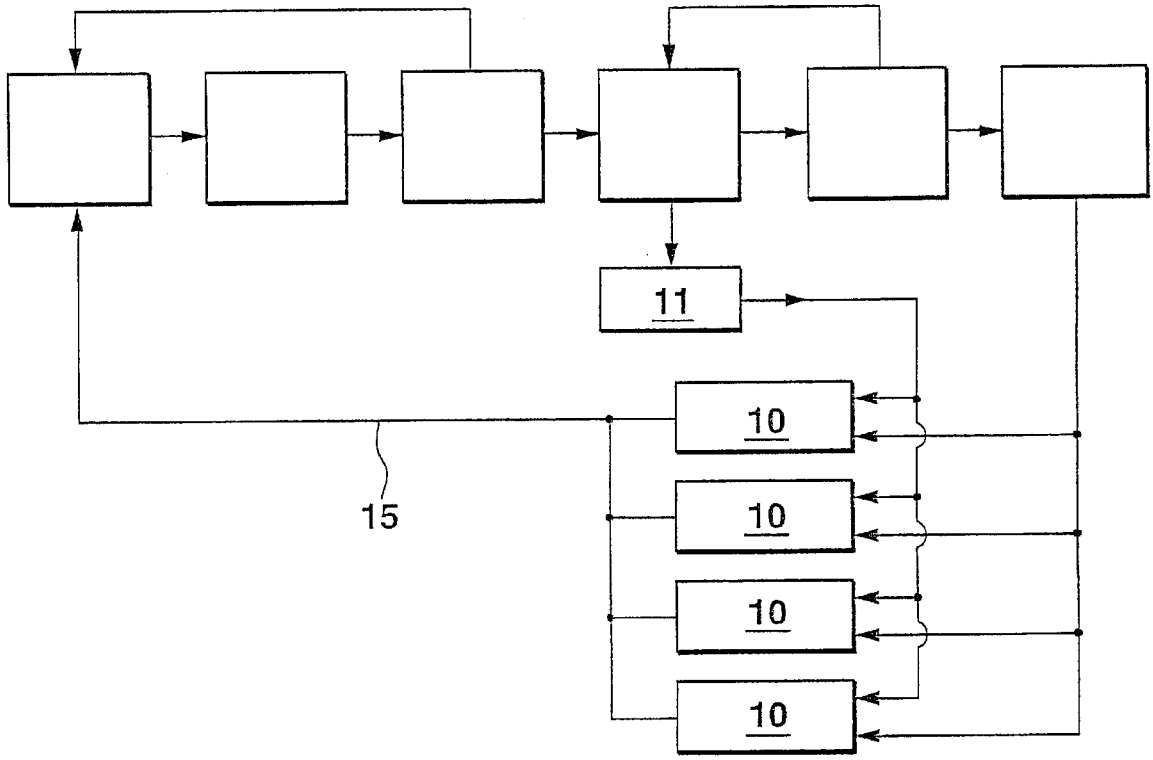
FIG. 2*a*, an exemplary embodiment with a central valve unit for triggering the injectors at the lower system pressure and with one common leakage line for all the injectors.
Figure 2B:
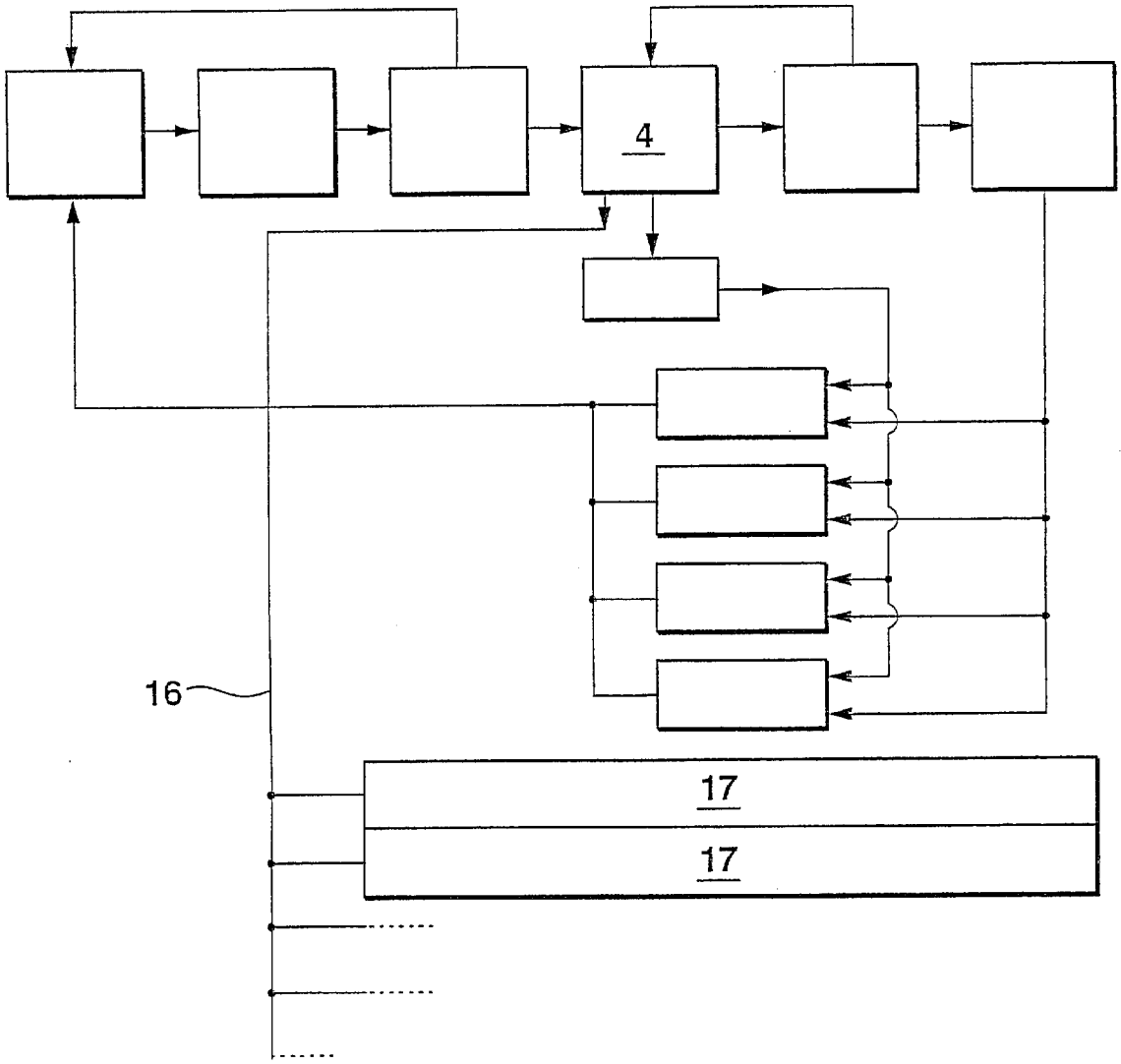
FIG. 2*b*, an exemplary embodiment corresponding to FIG. 2*a*, in which additionally further control units are hydraulically triggered with the lower system pressure.
Figure 2C:
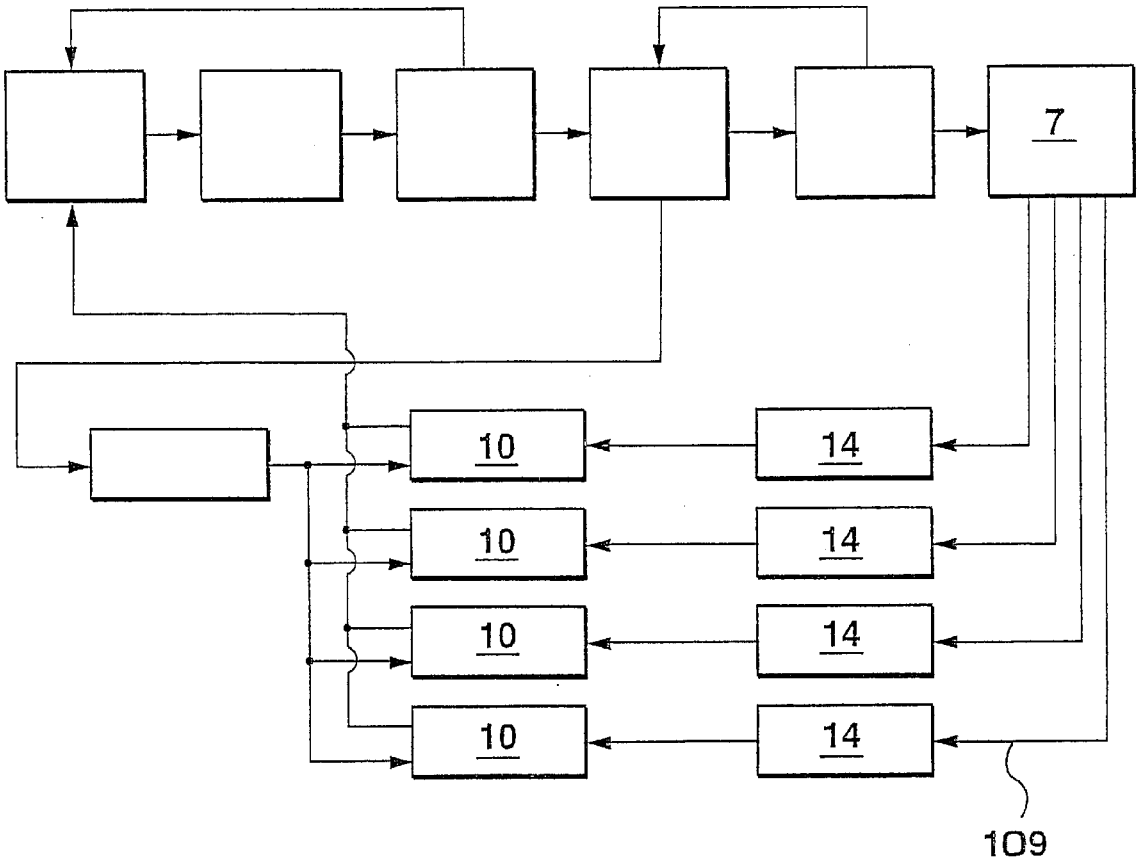
FIG. 2*c*, an exemplary embodiment corresponding to FIG. 2*a*, in which in addition one valve unit for the higher system pressure is provided for each injector.

In a departure from the exemplary embodiment of FIG. 1*a*, in FIG. 2*a*, in order to carry away leakage, the common line 15 communicates not with the central valve unit 11 but rather with the injectors 10. The pressure of the first high-pressure stage can for instance also be used to enable a hydraulic valve adjustment of the inlet and outlet valves, enable an adjustment of the camshaft, enable an actuation of engine braking systems, and so forth. To that end, in the exemplary embodiment shown in FIG. 2*b*, the first pressure reservoir 4 communicates additionally via a line 16 and via valve units 17 with one or more hydraulic control units (not shown) of the fuel injection system. The exemplary embodiment of FIG. 2*c* differs from that of FIG. 2*a* in that the injectors 10 communicate with the pressure reservoir 7 via separate high-pressure lines 109. Via one (local) valve unit 14 in each high-pressure line 109, the injection can be controlled individually for each cylinder.

Figure 3A:
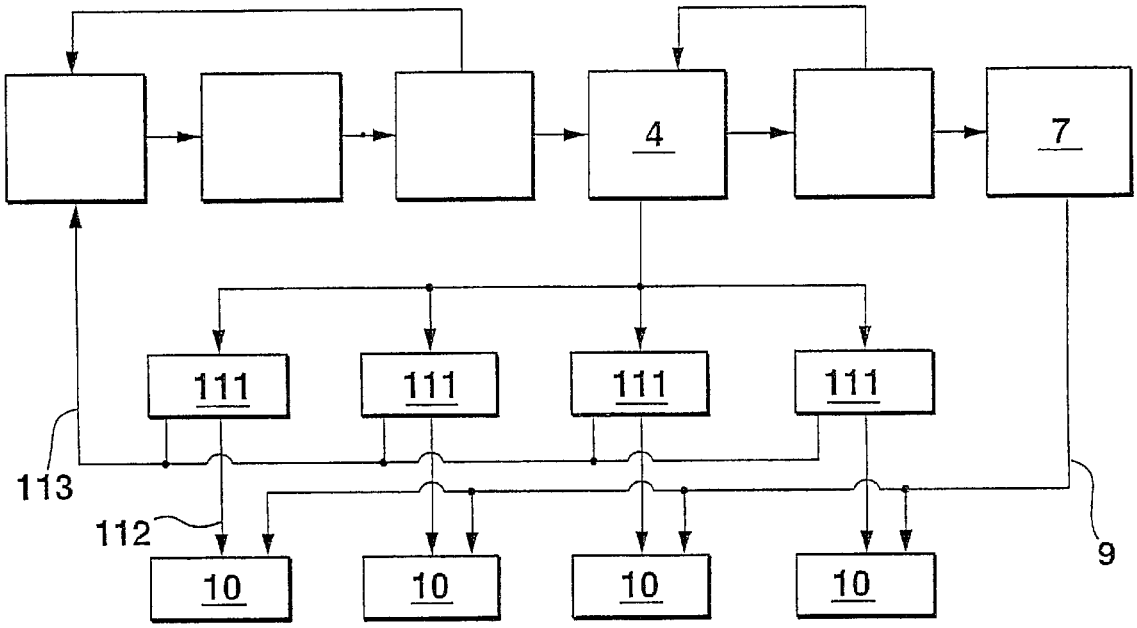
FIG. 3*a*, an exemplary embodiment with one valve unit for each injector for triggering at the lower system pressure and with a common leakage line for all the valve units.
Figure 3B:
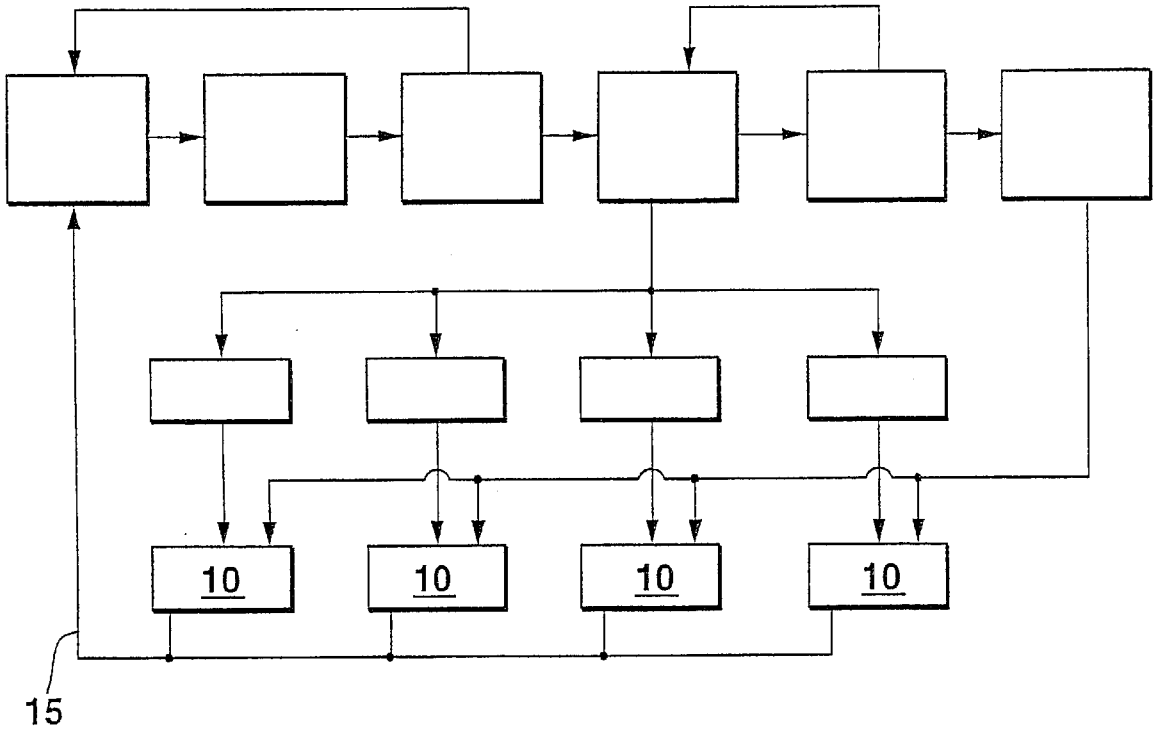
FIG. 3*b*, an exemplary embodiment corresponding to FIG. 3*a*, in which the common leakage line is provided for the injectors.
Figure 3C:
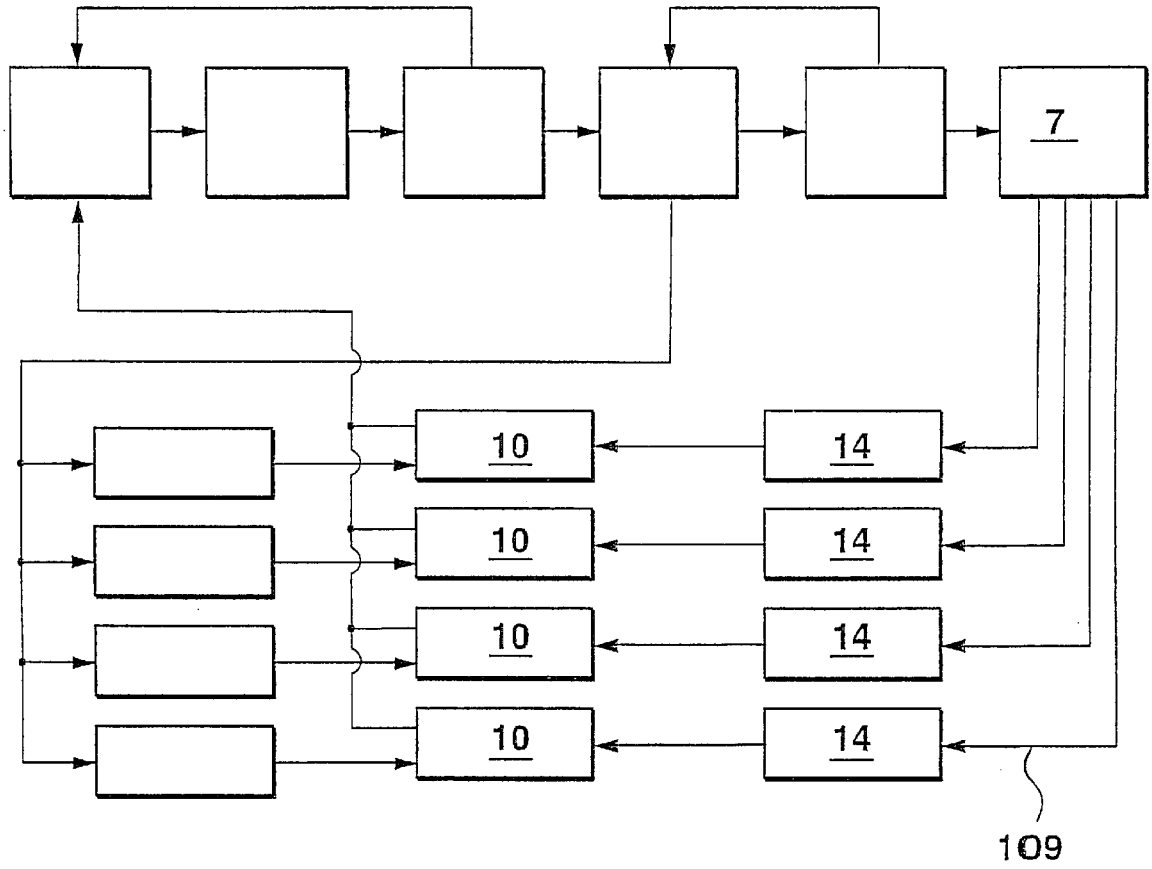
FIG. 3*c*, an exemplary embodiment corresponding to FIG. 3*a*, in which in addition one valve unit for the higher system pressure is provided for each injector.

FIGS. 3*a*–3*c* show exemplary embodiments in which the fuel from the first pressure reservoir 4 is metered to the individual injectors 10 not centrally via a single valve unit but rather separately via lines 112, each with one valve unit 111 for each injector 10. While in the exemplary embodiment of FIG. 3*a*, one common line 113 is provided for all these valve units 111 for diverting leakage in the direction of the fuel tank, in FIG. 3*b* a common line 15, also leading to the fuel tank 1, is provided for the injectors 10. Finally, FIG. 3 also shows an injection system in which in addition, each injector 10 is provided with its own high-pressure line 109 and with a separate valve unit 14 for the higher system pressure.

The valves 11, 111, 14 can be embodied as piezoelectric or magnet valves.

The foregoing relates to a preferred exemplary embodiments of the invention, it being understood that other embodiments and variants thereof are possible within the spirit and scope of the invention, the latter being defined by the appended claims.

I claim:

1. A fuel injection system for an internal combustion engine, having at least two different, high system pressures, having a first pressure reservoir (4), supplied by a first pump (3), for a lower system pressure, and having a second pressure reservoir (7), supplied by a second pump (6), for a higher system pressure, in which, for a fuel injection, injectors (10) of the individual cylinders of the engine can be made to communicate alternatively either with the first pressure reservoir (4) or with the second pressure reservoir (7), the second pump (6) communicates on its inlet side with the first pressure reservoir (4), and the individual injectors (10) communicate with the first pressure reservoir (4) via a central valve unit (11).

2. The fuel injection system of claim 1, in which a leakage line (5) is provided, leading from the first pump to the fuel tank (1).

3. The fuel injection system of claim 1, in which a leakage line (8) is provided leading from the second pump to the first pressure reservoir (4).

4. The fuel injection system of claim 1, in which a leakage line (13) leading from the central valve unit to the fuel tank (1), is provided.

5. The fuel injection system of claim 1, in which a leakage line (15) is provided leading from each of the injectors to the fuel tank (1).

6. The fuel injection system of claim 1, in which the first pressure reservoir (4) communicates with at least one hydraulic control unit of the fuel injection system via one or more valve units (17).

7. The fuel injection system of claim 1, in which the two pumps (3, 6) are combined in a common housing into two pumping stages.

8. A fuel injection system for an internal combustion engine, having at least two different, high system pressures, having a first pressure reservoir (4), supplied by a first pump (3), for a lower system pressure, and having a second pressure reservoir (7), supplied by a second pump (6), for a higher system pressure, in which, for a fuel injection, injectors (10) of the individual cylinders of the engine can be made to communicate alternatively either with the first pressure reservoir (4) or with the second pressure reservoir (7), the second pump (6) communicates on its inlet side with the first pressure reservoir (4), and the individual injectors (10) communicate with the first pressure reservoir (4) respectively each via local valve units (111).

9. The fuel injection system of claim 8, in which a leakage line (5) is provided, leading from the first pump to the fuel tank (1).

10. The fuel injection system of claim 8, in which a leakage line (8) is provided leading from the second pump to the first pressure reservoir (4).

11. The fuel injection system of claim 8, in which a leakage line (113) leading from each of the local valve units to the fuel tank (1), is provided.

12. The fuel injection system of claim 8, in which a leakage line (15) is provided leading from each of the injectors to the fuel tank (1).

13. The fuel injection system of claim 8, in which the first pressure reservoir (4) communicates with at least one hydraulic control unit of the fuel injection system via one or more valve units (17).

14. The fuel injection system of claim 8, in which the two pumps (3, 6) are combined in a common housing into two pumping stages.

* * * * *